US006719601B2

(12) United States Patent
Oga et al.

(10) Patent No.: US 6,719,601 B2
(45) Date of Patent: Apr. 13, 2004

(54) FLUORESCENT LAMP AND METHOD FOR MANUFACTURING THE FLUORESCENT LAMP

(75) Inventors: Toshiyoshi Oga, Otsu (JP); Noriyuki Uchida, Hirakata (JP); Nobuyuki Tsubakihara, Takatsuki (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/385,045

(22) Filed: Mar. 10, 2003

(65) Prior Publication Data

US 2003/0168983 A1 Sep. 11, 2003

Related U.S. Application Data

(62) Division of application No. 09/553,217, filed on Apr. 20, 2000, now Pat. No. 6,597,105.

(30) Foreign Application Priority Data

Apr. 22, 1999 (JP) ..... 11-115394

(51) Int. Cl.[7] ..... H01J 9/00; H01J 9/24

(52) U.S. Cl. ..... 445/26; 445/22; 445/27; 445/29; 174/17.05; 174/17.07; 65/439; 65/138; 65/139; 65/140

(58) Field of Search ..... 445/22, 26, 29, 445/27; 313/490; 174/17.05, 17.07; 65/439, 138, 139, 140

(56) References Cited

U.S. PATENT DOCUMENTS

| | | | | |
|---|---|---|---|---|
| 4,469,983 A | | 9/1984 | Grahmann et al. | |
| 5,204,584 A | | 4/1993 | Ikeda et al. | |
| 5,378,183 A | * | 1/1995 | Preston | 445/26 |
| 5,719,465 A | | 2/1998 | Den Breeijen et al. | |

FOREIGN PATENT DOCUMENTS

| | | |
|---|---|---|
| EP | 0 327 346 | 8/1989 |
| EP | 0 327 346 | 9/1989 |
| EP | 0 569 814 | 11/1993 |
| EP | 0 758 795 | 2/1997 |
| EP | 0 918 352 | 5/1999 |
| JP | 01063261 | 3/1989 |
| JP | 2-16513 | 5/1990 |
| JP | 04280033 | 10/1992 |
| JP | 04289655 | 10/1992 |
| JP | 6-290746 | 10/1994 |
| JP | 11-345592 | 12/1999 |
| JP | 2000048768 | 2/2000 |
| WO | 98/57354 | 12/1998 |

* cited by examiner

*Primary Examiner*—Kenneth J. Ramsey
*Assistant Examiner*—Mariceli Santiago
(74) *Attorney, Agent, or Firm*—Merchant & Gould P.C.

(57) ABSTRACT

A fluorescent lamp capable of fully securing a portion for containing a mercury amalgam pellet and reliably preventing the mercury amalgam pellet from moving toward the inside a discharge tube, and a method for manufacturing the fluorescent lamp. The fluorescent lamp includes a glass tube having a fluorescent substance layer on the inner surface, a sealed portion formed at an end of the glass tube, a slender glass tube having an inner space that is in communication with the inside of the glass tube and is not in communication with the outside of the glass tube, and a mercury amalgam pellet contained in the slender glass tube. The slender glass tube has a small-diameter part with an inner diameter smaller than the diameter of the mercury amalgam pellet and a large-diameter part with an inner diameter larger than the diameter of the mercury amalgam pellet. The slender glass tube is welded to the glass tube so that the small-diameter part is placed in the sealed portion and the large-diameter part is placed further away from the glass tube than the smaller-diameter part.

9 Claims, 7 Drawing Sheets

FLUORESCENT LAMP AND METHOD FOR MANUFACTURING THE FLUORESCENT LAMP

This application is a divisional of application Ser. No. 09/553,217, filed Apr. 20, 2000 now U.S. Pat. No. 6,597,105, which application(s) are incorporated herein by reference.

FIELD OF THE INVENTION

The present invention relates to a fluorescent lamp capable of adjusting a mercury vapor pressure in a discharge tube by using an amalgam.

BACKGROUND OF THE INVENTION

A fluorescent lamp uses fluorescence, which is obtained by exciting a fluorescent substance layer formed on an inner wall of a glass tube with an ultraviolet ray, as a light source. As the ultraviolet ray, a resonance line of mercury is widely used. In general, pure mercury is filled in a glass tube of a fluorescent lamp. In such a fluorescent lamp, when the temperature of the coolest portion of the lamp is about 40° C. and the ambient temperature around the lamp is about 25° C., the mercury vapor pressure in the glass tube becomes suitable, and the maximum luminous efficiency can be attained. However, in a compact fluorescent lamp produced, for example, by using a bent glass tube such as a U-shaped glass tube, etc. or, by connecting a plurality of glass tubes, the ambient temperature around the lamp is easily increased. Consequently, the lamp temperature tends to be increased.

Therefore, there have been proposed methods for placing a mercury amalgam pellet at a portion corresponding to the coolest portion in a fluorescent lamp so that the mercury vapor pressure in the glass tube is adjusted to fall within the appropriate range even if the temperature of the fluorescent lamp is increased. The mercury amalgam pellet is generally placed in the slender glass tube that is provided so as to be in communication with the glass tube that is a discharge tube. In this case, a slender glass tube is provided with a means for adjusting the location of the amalgam pellet and for preventing the mercury amalgam pellet from moving toward the inside of the discharge tube. Examples of the structure of the fluorescent lamp having such a means include, for example, a structure shown in FIG. 7 (disclosed in, for example, JP 2-16513 Y), a structure including a member for preventing the mercury amalgam pellet from moving toward the inside of the glass tube (which will also be referred to as "a moving prevention member" hereinafter) in a slender glass tube, or the like. The structure of the fluorescent lamp shown in FIG. 7 includes a glass tube 10 having a fluorescent substance layer 11 on the inner surface, a sealed portion 12 provided at the end of the glass tube 10, and a slender glass tube 14 penetrating through the sealed portion 12, and the slender glass tube 14 has a narrow portion 15 on the portion protruding outward from the sealed portion 12. In the fluorescent lamp shown in FIG. 7, between the end of the slender glass tube 14 and the narrow portion 15, a mercury amalgam pellet 13 is held.

Recently, in a compact fluorescent lamp such as a compact self-ballasted fluorescent lamp, as further miniaturization increasingly has been demanded, a more slender glass tube has been used as a discharge tube. As to a slender glass tube containing a mercury amalgam pellet, a further slender and shorter tube tends to be used. When such a slender and short slender glass tube is used, in a structure shown in FIG. 7, the part of the slender glass tube 14 protruding outward from the sealed portion 12 is shortened. Therefore, it is difficult to form a narrow portion 15 while securing a sufficient portion containing mercury amalgam pellet 13. Furthermore, there is a risk that a slender glass tube 14 may be pressed and collapsed when the narrow portion 15 is formed. Furthermore, in the structure in which the moving prevention member is inserted into the slender glass tube, when the slender glass tube is used as an evacuation tube in manufacturing the fluorescent lamp, the moving prevention member may inhibit a smooth evacuation, which may lead to a defective evacuation in the fluorescent lamp.

SUMMARY OF THE INVENTION

It is an object of the present invention to solve the problems of the prior art. That is, the object of the present invention is to provide a fluorescent lamp capable of reliably preventing a mercury amalgam pellet from moving toward the inside of a glass tube while fully securing a portion for containing the mercury amalgam pellet.

In order to achieve the above-mentioned objects, according to a first aspect of the present invention, a fluorescent lamp includes a glass tube having a fluorescent substance layer on the inner surface, a sealed portion formed at the end of the glass tube, a container having an inner space that is in communication with the inside of the glass tube and is not in communication with the outside of the glass tube, and a mercury amalgam pellet contained in the container. In the fluorescent lamp of this configuration, the sealed portion is provided with a through hole for allowing communication between the glass tube and the container, and at least a part of the through hole in the sealed portion has an inner diameter smaller than the diameter of the mercury amalgam pellet.

With the fluorescent lamp having such a configuration, since the portion for preventing the moving of the mercury amalgam pellet is formed in the sealed portion, it is possible to prevent the moving of the mercury amalgam pellet while fully securing the volume of the container, regardless of the length of the portion of the container protruding outward from the sealed portion. Furthermore, since there is no member corresponding to the moving prevention member in the through hole and the container, it is possible to attain sufficient evacuation efficiency even when the container and the through hole are used as an evacuation tube.

It is preferable in the above-mentioned fluorescent lamp that at least a part of the container is placed in the sealed portion. According to such a preferred configuration, even when the length of a portion of the container protruding outward from the sealed portion is short, it is possible to fully secure the sufficient volume of the container.

According to another aspect of the present invention, a fluorescent lamp includes a glass tube having a fluorescent substance layer on the inner surface, a sealed portion formed at the end of the glass tube, a slender glass tube having an inner space that is in communication with the inside of the glass tube and is not in communication with the outside of the glass tube, and a mercury amalgam pellet contained in the slender glass tube. In the fluorescent lamp of this embodiment, the slender glass tube having a small-diameter part with an inner diameter smaller than the diameter of the mercury amalgam pellet and a large-diameter part with an inner diameter larger than the diameter of the mercury amalgam pellet, is welded to the glass tube so that the small-diameter part is placed in the sealed portion and the large-diameter part is placed further away from the glass tube than the smaller-diameter part.

Also in the fluorescent lamp having such a configuration, since the portion for preventing the moving of the mercury amalgam pellet is formed in the sealed portion, it is possible to prevent the amalgam pellet from moving while fully securing the volume of the portion for containing the mercury amalgam pellet. Furthermore, since there is no member corresponding to the moving prevention member in the slender glass tube, even when the glass tube is used as an evacuation tube, it is possible to attain sufficient evacuation efficiency.

It is preferable in the above-mentioned fluorescent lamp that at least a part of the large-diameter part is placed in the sealed portion. With such a preferred configuration, even in a case where the part of the slender glass tube protruding outward from the sealed portion is short, it is easy to secure the sufficient volume of the portion containing the mercury amalgam pellet.

According to a further aspect of the present invention, a method for manufacturing a fluorescent lamp includes: inserting a molding stick having a large-diameter part and a small-diameter part, which have different diameters, into a slender glass tube; forming a fluorescent substance layer on the inner surface of a glass tube; placing the slender glass tube at the open end of the glass tube so that the large-diameter part of the molding stick is located further away from the glass tube than the small-diameter part of the molding stick; sealing the open end of the glass tube and then drawing out the molding stick from the slender glass tube; placing a mercury amalgam pellet in the slender glass tube; and sealing an open end of the slender glass tube located outward from the glass tube. In such a method, when sealing the open end of the glass tube, at least a part of the slender glass tube in which the small-diameter part of the molding stick is inserted is welded to the glass tube, and the inner diameter of the slender glass tube is kept larger than the diameter of the amalgam pellet in the part in which the large-diameter part of the molding stick is inserted and is reduced to be smaller than the diameter of the mercury amalgam pellet in the part in which the small-diameter part of the molding stick is inserted and welded to the glass tube.

The phrase "having a large-diameter part and a small-diameter part, which have different diameters" means that the molding stick has two parts each having a different diameter and the part having a larger diameter is referred to as a large-diameter part and the part having a smaller diameter is referred to as a small-diameter part.

According to such a manufacturing method, a portion for preventing the moving of the mercury amalgam pellet can be formed while the glass tube is sealed at the same time, and, in addition, can be formed in the sealed portion. Furthermore, even after the sealing process, the slender glass tube has a larger diameter than that of the mercury amalgam pellet in the part in which the large-diameter part of the molding stick is inserted. Consequently, it is easy to secure the portion for containing the mercury amalgam pellet. Therefore, it is made possible to manufacture the fluorescent lamp of the present invention without separately carrying out a process for molding the slender glass tube. Furthermore, when reducing the inner diameter of a certain part of the slender glass tube, the molding stick is inserted into the slender glass tube, so that it is possible to prevent the slender glass tube from being pressed and collapsed. Therefore, even when the slender glass tube is used as an evacuation tube, it is possible to attain sufficient evacuation efficiency.

It is preferable in the above-mentioned method that the glass tube is evacuated by using the slender glass tube as an evacuation tube before placing the mercury amalgam pellet in the slender glass tube. When a member other than the slender glass tube is used as an evacuation tube, after the mercury amalgam pellet is inserted into the slender glass tube and before the evacuation is completed, it is necessary to cool the glass tube and slender glass tube in order to prevent the releasing of mercury from the mercury amalgam pellet. However, according to such a preferred embodiment of the present invention, the above-mentioned cooling operation is not necessary because the mercury amalgam pellet is inserted into the glass tube after evacuation.

DETAILED DESCRIPTION OF THE INVENTION

Hereinafter, the present invention will be described by way of embodiments with reference to drawings.

Figure 1:
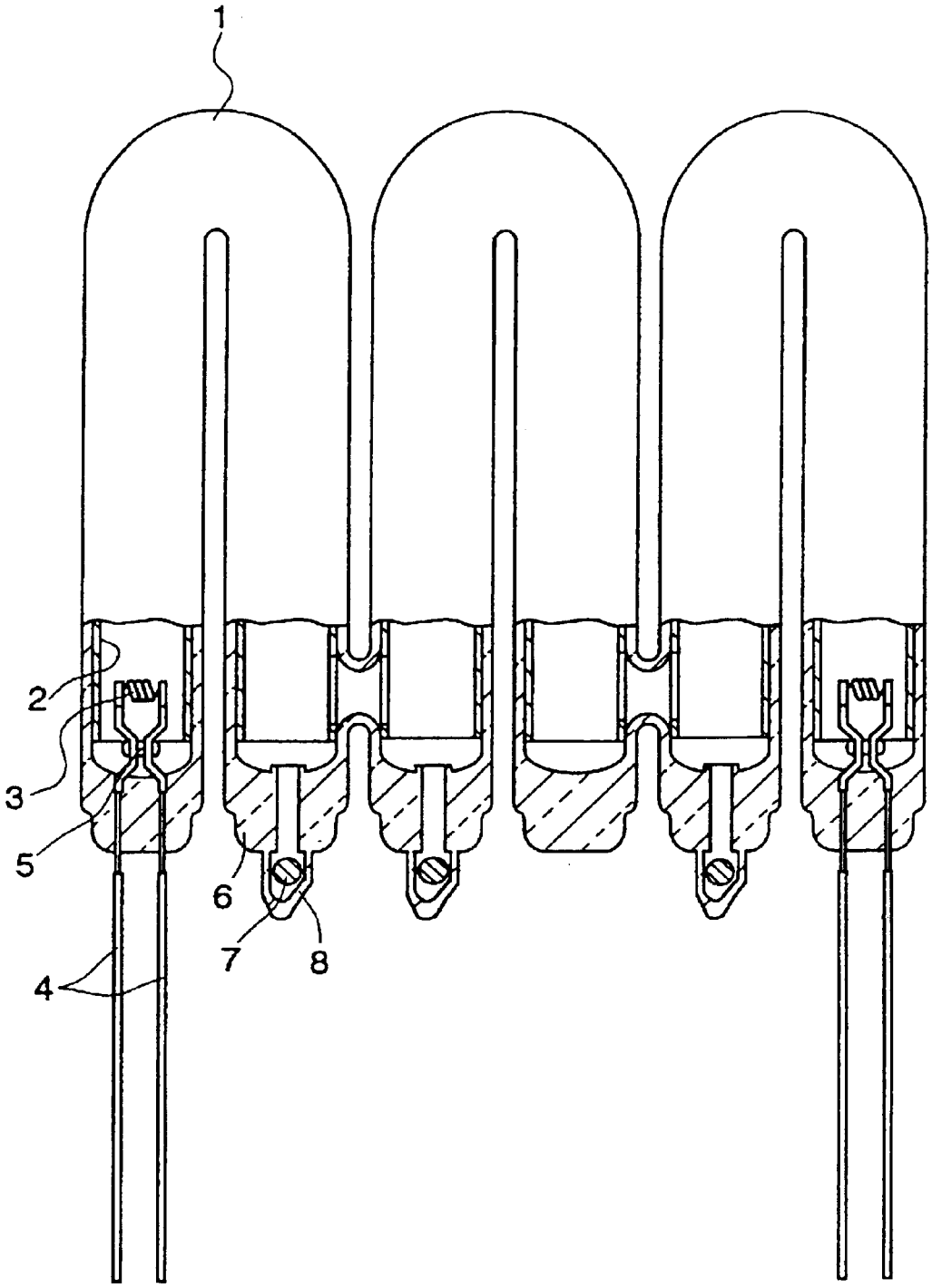
FIG. 1 is a partial cutaway front view of a fluorescent lamp according to a first embodiment of the present invention.

FIG. 1 is a cross-sectional view showing a structure of a fluorescent lamp according to a first embodiment of the present invention. In this embodiment, a glass tube 1 is used as a discharge tube in which three U-shaped molded bulbs are connected so that their inner spaces are in communication with each other. A fluorescent substance layer 2 is formed on the inner surface of the glass tube 1. The U-shaped molded bulbs are sealed with the sealed portion. Inside the molded bulb, a predetermined amount of inert gas (for example, argon, etc.) is filled. At least one of the U-shaped molded bulbs or, preferably, all of the U-shaped molded bulbs, has a slender glass tube 8 containing a mercury amalgam pellet 7. Furthermore, each of the U-shaped molded bulbs arranged at both ends is provided with an electrode. Each electrode includes a filament electrode 3, lead wires 4 and a glass bead 5.

Figure 2:
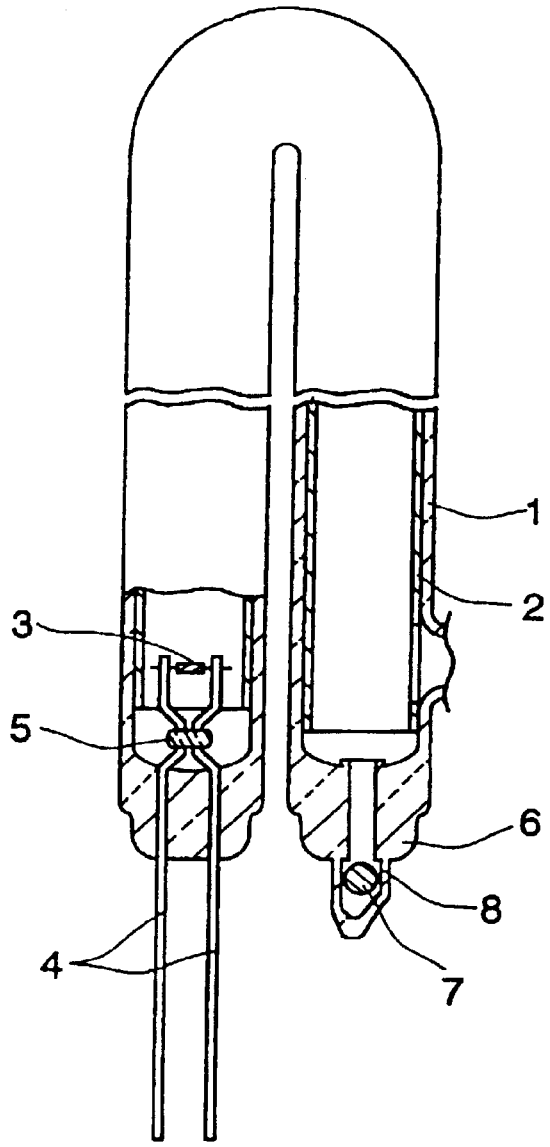
FIG. 2 is a partial cutaway front view showing a partly enlarged portion of the fluorescent lamp of FIG. 1.

FIG. 2 shows a structure of the U-shaped molded bulb, which is located at an end, constituting the fluorescent lamp of FIG. 1.

The U-shaped molded bulb 1 is sealed with sealed portions at both ends. Two lead wires 4 pass through one sealed portion. Between the two lead wires 4, the filament electrode 3 is installed. This filament electrode 3 is located in the U-shaped molded bulb 1. The interval between the two lead wires 4 is adjusted by the glass bead 5. Another sealed portion 6 is provided with a slender glass tube 8 containing the mercury amalgam pellet 7.

Figure 3:
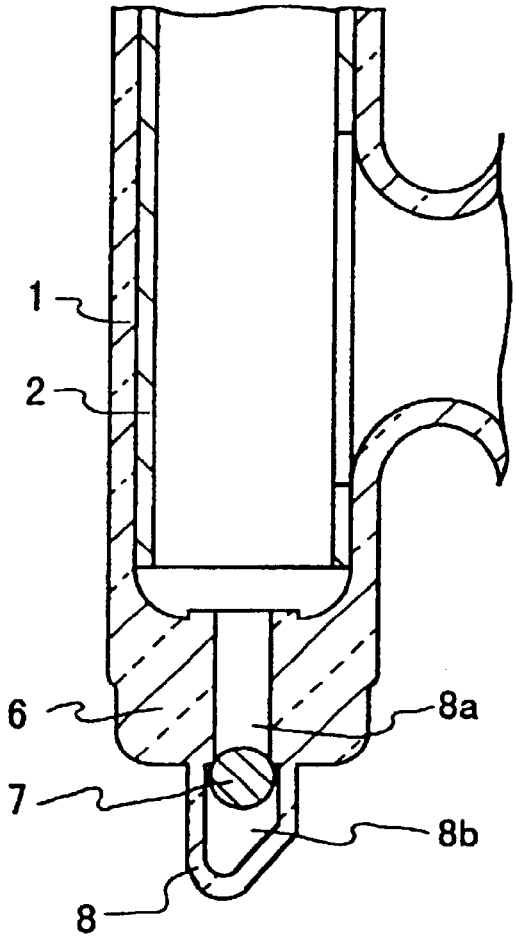
FIG. 3 is an enlarged cross-sectional front view showing the structure of a portion of the fluorescent lamp of FIG. 1 containing a mercury amalgam pellet.

FIG. 3 shows a structure of the part around the sealed portion 6. The slender glass tube 8 passes through the sealed portion 6. The slender glass tube 8 is open at one end and closed at another end. The slender glass tube 8 is provided so that a portion including the closed end protrudes outward from the U-shaped molded bulb 1 and the open end is placed in the U-shaped molded bulb 1.

Furthermore, a small-diameter part 8*a* and a large-diameter part 8*b* are connected to form the slender glass tube 8. In the large-diameter part 8*b*, the mercury amalgam pellet 7 is contained. That is, in the fluorescent lamp of the first embodiment, the large-diameter part 8*b* forms a container for containing the amalgam pellet 7, and the small-diameter part 8*a* forms a through hole for allowing communication between the large-diameter part (container) 8*b* and the inner space of the U-shaped molded bulb 1.

The large-diameter part 8*b* is provided so that at least a part of the large-diameter part 8*b* protrudes from the sealed portion 6 outward from the U-shaped molded bulb 1. The inner diameter of at least a part of the large-diameter part 8*b* is set to be larger than the diameter of the mercury amalgam pellet 7 in order to contain the mercury amalgam pellet 7.

The small-diameter part 8*a* functions as a passage for allowing communication between the inner space of the U-shaped molded bulb 1 and the inner space of the large-diameter part 8*b*. The small-diameter part 8*a* is located closer to the U-shaped molded bulb 1 than the large-diameter part 8*b* and forms the portion penetrating through the sealed portion 6 in the slender glass tube 8. The inner diameter of at least a part of the small-diameter part 8*a* is set to be smaller than the diameter of the mercury amalgam pellet 7 in order to prevent the mercury amalgam pellet 7 from passing through the small-diameter part 8*a*.

As shown in FIG. 3, the boundary between the small-diameter part 8*a* and large-diameter part 8*b* forms a step in which the diameter changes in stepwise. Furthermore, the boundary also may form a slanted surface in which the inner diameter continuously changes.

As mentioned above, the inner diameters of the small-diameter part 8*a* and the large-diameter part 8*b* are set in accordance with the diameter of the mercury amalgam pellet 7 to be contained. Hereinafter, one example of the specific diameter will be described. The diameter of the mercury amalgam pellet 7 is, for example, 2 to 2.5 mm, and preferably 2.2 mm. The inner diameter of the small-diameter part 8*a* is, for example, 0.5 to 2 mm, and preferably 1.2 mm. Furthermore, the inner diameter of the large-diameter part 8*b* is, for example, 3.0 to 3.5 mm and preferably about 3.1 mm.

Furthermore, the length of the large-diameter part 8*b* is not particularly limited as long as it is larger than the diameter of the mercury amalgam pellet 7. The length is, for example, 3 to 15 mm, preferably 3 to 10 mm, and more preferably about 4 mm. In this embodiment, the length of the large-diameter part 8*b* corresponds to the length of the portion of the slender glass tube 8 protruding from the sealed portion 6.

Furthermore, the length of the small-diameter part 8*a* is appropriately decided in accordance with the full length of the slender glass tube. The length is, for example, 3 to 15 mm, preferably 4 to 13 mm, more preferably 4 to 10 mm, and most preferably about 6 mm.

Figure 4:
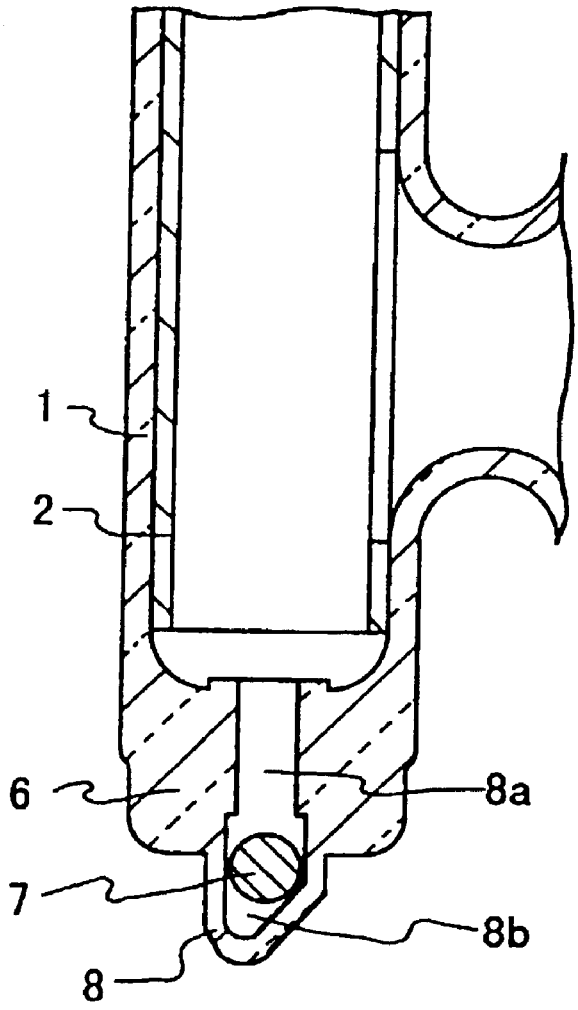
FIG. 4 is an enlarged cross-sectional front view showing a structure of a portion containing a mercury amalgam pellet of a fluorescent lamp according to a second embodiment of the present invention.

FIG. 4 shows a fluorescent lamp according to a second embodiment of the present invention. The embodiment shown in FIG. 4 is particularly suitable to the case where a slender glass tube is short. Moreover, in FIGS. 4 and 3, the corresponding members are given the same numbers.

In the second embodiment, the sealed portion 6 is provided with a slender glass tube having the small-diameter part 8*a* and the large-diameter part 8*b*. The small-diameter part 8*a* and a part of the large-diameter part 8*b* are located in the sealed portion 6. That is, in the fluorescent lamp according to the second embodiment, a part of the large-diameter part 8*b* constituting the container for containing the mercury amalgam pellet 7 is buried in the sealed portion 6.

Furthermore, in this embodiment, as compared with the first embodiment, the small-diameter part 8*a* is shorter by the part of the large-diameter part 8*b* buried in the sealed portion 6. The length of the small-diameter part 8*a* is, for example, 0.5 to 8 mm, preferably 1 to 5 mm, and more preferably 1 to 3 mm. Furthermore, the inner diameter of the small-diameter part 8*a* is not particularly limited, and can be set similarly to the first embodiment.

Furthermore, a part of the large-diameter part 8*b* is buried in the sealed portion 6, so that the length of the portion of the large-diameter part 8*b* protruding from the sealed portion 6 is shorter as compared with the first embodiment. The length of the portion of the large-diameter part of 8*b* protruding from the sealed portion 6 (i.e., the portion that is not buried in the sealed portion 6) is, for example, 2 to 10 mm, preferably 2 to 8 mm, and more preferably 2 to 5 mm.

Moreover, the full length of the large-diameter part 8*b* is not particularly limited as long as it is larger than the diameter of the mercury amalgam pellet 7 and it can be set similarly to the first embodiment. Also, the inner diameter of the large-diameter part 8*b* can be set similarly to the first embodiment.

According to such a configuration, it is possible to secure reliably the volume of the portion for containing the mercury amalgam pellet by placing a part of the large-diameter part 8*b* in the sealed portion 6. Furthermore, since the small-diameter part 8*a* is shorter as compared with the first embodiment, excellent evacuation efficiency can be achieved even when the slender glass tube 8 is used as an evacuation tube in manufacture.

Figure 5:
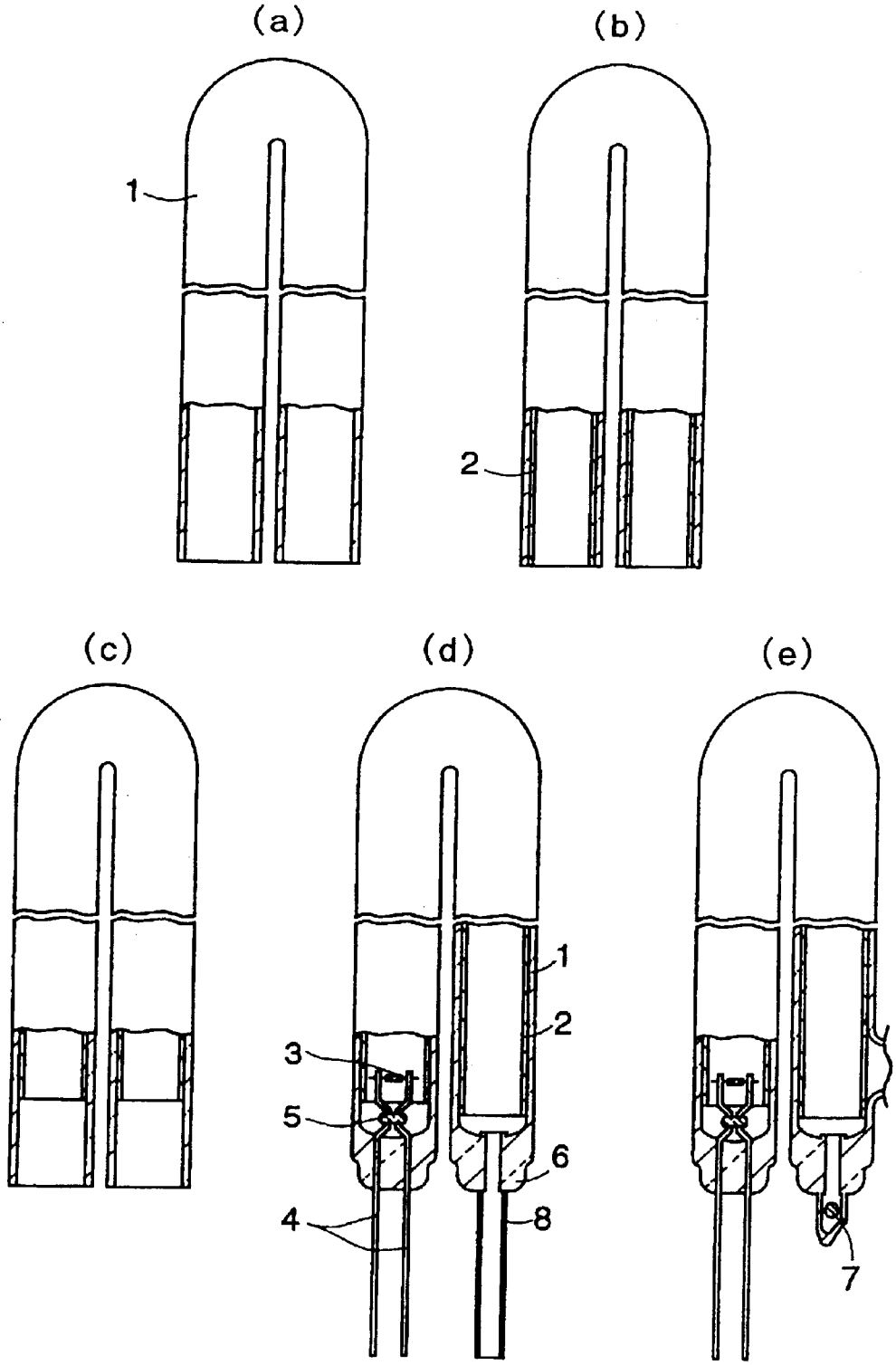
FIG. 5 is a view explaining a manufacturing process for a fluorescent lamp according to the present invention.

FIG. 5 shows a process for manufacturing the fluorescent lamp of the FIG. 1. A method for manufacturing the fluorescent lamp according to the present invention will be described with reference to FIG. 5.

First, a straight glass tube is molded into a U-shaped tube by using a molding block, thus to form a U-shaped molded bulb 1 (FIG. 5(*a*)). Next, a fluorescent layer 2 is formed on the inner surface of the U-shaped molded bulb 1 (FIG. 5(*b*)), and then the fluorescent layer 2 is removed at the both ends of the U-shaped molded bulb 1 (FIG. 5(*c*)).

In the meanwhile, the filament electrode 3 is installed between the ends of the two lead wires 4, and the glass bead 5 is placed so as to adjust the interval between the lead wires 4. Thus, the electrode is fabricated.

The electrode is inserted into one open end of the U-shaped molded bulb and then the open end is sealed. Moreover, the slender glass tube 8 is inserted into another open end of the U-shaped molded bulb, and then the open end is sealed so as to form the sealed portion 6 (FIG. 5(*d*)). The sealing process is carried out by heating the portion to be sealed in the U-shaped molded bulb 1 to the softening temperature and pinching it.

Next, as shown in FIG. 1, the U-shaped molded bulb 1 and the two U-shaped molded bulbs that were separately prepared are connected to be formed as one unit. Furthermore, the U-shaped molded bulb 1 is evacuated by using the slender glass tube 8 as an evacuation tube. Thereafter, the filament electrode 3 is activated, an inert gas is filled into the U-shaped bulb 1, the mercury amalgam pellet 7 is inserted into the slender glass tube 8, and then the slender glass tube 8 is sealed. Through the above-mentioned series of processes, the fluorescent lamp according to the present invention is obtained (FIG. 5(*e*)).

Figure 6:
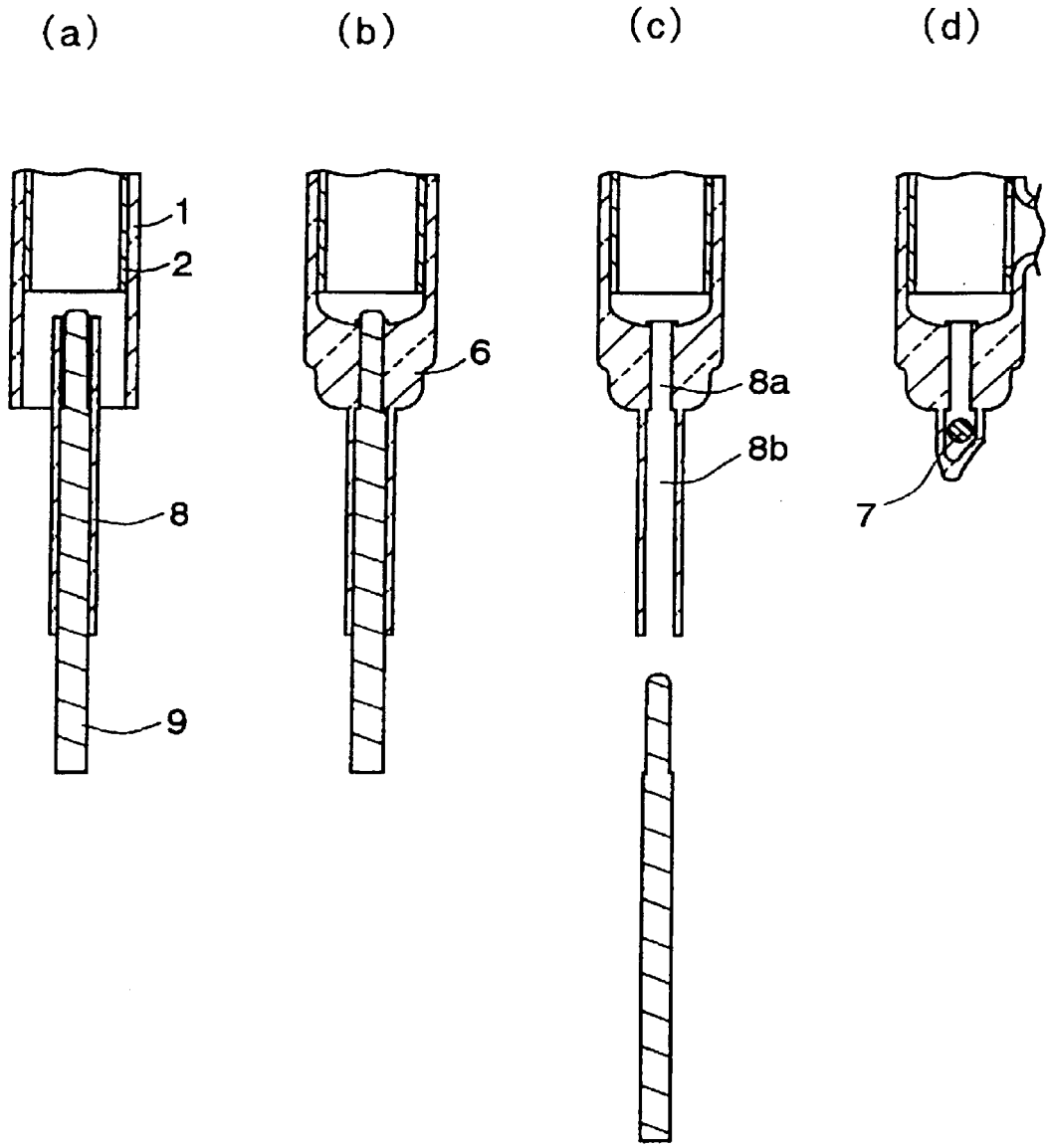
FIG. 6 is a view explaining a periphery of the portion containing a mercury amalgam pellet of the fluorescent lamp in the processes from FIG. 5 (c) to FIG. 5(*e*).
Figure 7:
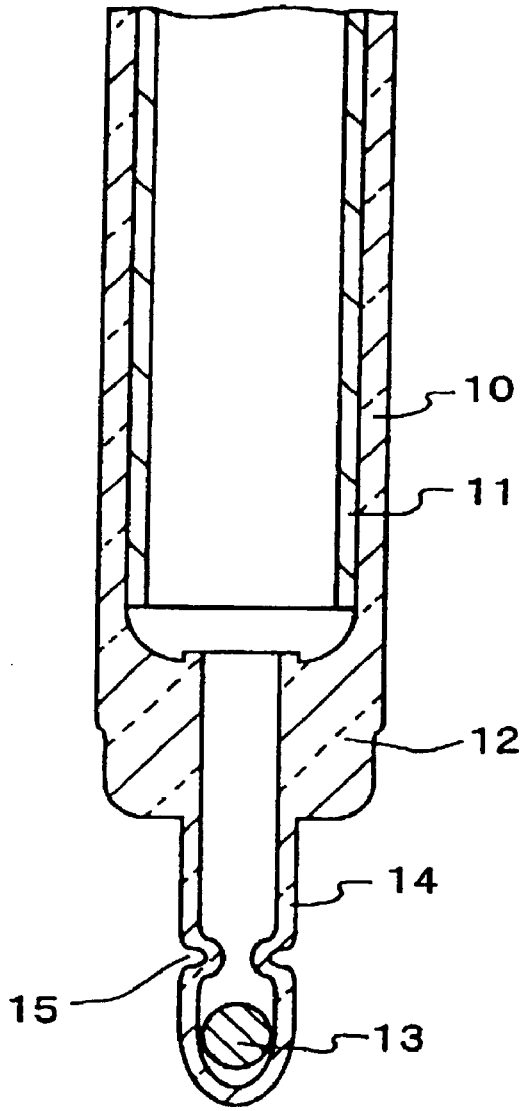
Fig. 7 (PRIOR ART)
FIG. 7 is an enlarged cross-sectional front view showing a structure of the portion containing a mercury amalgam pellet of a fluorescent lamp of the prior art.

Hereinafter, the process from FIG. 5(*c*) to FIG. 5(*e*) will be explained in detail with reference to FIG. 6. FIG. 6 shows a part of the fluorescent lamp shown in FIG. 3.

First, a molding stick 9 is inserted into the slender glass tube 8. The slender glass tube 8 is a straight-shaped glass tube having a substantially constant inner diameter. The inner diameter of the slender glass tube is larger than the diameter of the mercury amalgam pellet to be later contained in the slender glass tube 8. Furthermore, the molding stick 9 is a stick having a small-diameter part and a large-diameter part. The diameter of the molding stick 9 is smaller than the diameter of the amalgam pellet in the small-diameter part and larger than the diameter of the amalgam pellet in the large-diameter part. An example of metals usable for the molding stick 9 includes a metal having a releasing property with respect to the glass, for example, tungsten, stainless steel, brass, and the like. The molding stick 9 may be an article of cast metal.

The slender glass tube 8 into which the molding stick 9 is inserted is placed in the open end of the U-shaped molded bulb 1 (FIG. 6(*a*)). At this time, the slender glass tube 8 is placed so that the small-diameter part of the molding stick is located closer to the U-shaped molded bulb 1 than the large-diameter part.

Next, the open end of the U-shaped molded bulb 1 provided with a slender glass tube 8 is heated and sealed by using a pincher (FIG. 6(*b*)). The heating temperature is not particularly limited and it may be any temperatures as long as it is not less than the softening temperature of the slender glass tube 8 (for example 665° C.). The temperature is, for example, 900 to 1250° C., and preferably 1000 to 1200° C.

According to such a process, the sealed portion 6 through which the slender glass tube 8 penetrates is formed at the end of the U-shaped molded bulb 1. Furthermore, at the same time, the inner surface of the part of the slender glass tube 8, which penetrates through the sealed portion 6, is formed in a shape patterned by the stepped molding stick 9. In other words, in the slender glass tube 8, the small-diameter part 8*a* having an inner diameter smaller than the diameter of the mercury amalgam pellet to be later contained and the large-diameter part 8*b* having an inner diameter larger than the diameter of the mercury amalgam pellet 7 are formed. And the large-diameter part 8*b* is further away from the U-shaped bulb 1 than the small-diameter part 8*a*.

Thereafter, the molding stick 9 is drawn out from the slender glass tube 8 (FIG. 6(*c*)). Consequently, the inner space and the outer space of the U-shaped molded bulb 1 are in communication with each other via a slender glass tube 8.

Thereafter, the U-shaped molded bulb 1 is connected to the two U-shaped molded bulbs that were separately prepared. Thereafter, the U-shaped molded bulb 1 is evacuated by using the slender glass tube 8 as an evacuation tube. Next, the filament electrode 3 is activated and the inert gas is filled in the U-shaped molded bulb 1, and then the mercury amalgam pellet 7 is inserted into the slender glass tube 8. Thereafter, the end of the slender glass tube 8 is heated, sealed and cut (FIG. 6(*d*)).

Moreover, in the fluorescent lamp and the method for manufacturing the fluorescent lamp, the compact fluorescent lamp using a plurality of U-shaped molded bulbs as the discharge tube was described. The present invention is not necessary limited to this embodiment. The present invention will be applied to any shapes of fluorescent lamps, for example, a straight fluorescent lamp, a double U-shaped fluorescent lamp, and the like.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A method for manufacturing a fluorescent lamp comprising:

inserting a molding stick having a large-diameter part and a small-diameter part, which have different diameters, into a slender glass tube;

forming a fluorescent substance layer on the inner surface of a glass tube;

placing said slender glass tube at an open end of said glass tube so that said large-diameter part of said molding stick extends further away from said glass tube than said small-diameter part of said molding stick;

sealing the open end of said glass tube and then drawing out said molding stick from said slender glass tube;

placing a mercury amalgam pellet in said slender glass tube; and sealing an open end of said slender glass tube located further from said glass tube;

when sealing the open end of said glass tube, at least a part of said slender glass tube in which the small-diameter part of said molding stick is inserted is welded to said glass tube; and the inner diameter of said slender glass tube is kept larger than the diameter of said amalgam pellet in the part in which said large-diameter part of said molding stick is inserted and is reduced to be smaller than the diameter of said mercury amalgam pellet in the part in which said small-diameter part of said molding stick is inserted and which is welded to said glass tube.

2. The method for manufacturing a fluorescent lamp according to claim 1, wherein said glass tube is evacuated by using said slender glass tube as an evacuation tube, before placing the mercury amalgam pellet in said slender glass tube.

3. The method for manufacturing a fluorescent lamp according to claim 1, wherein at least a part of said slender glass tube into which the large-diameter part of said molding stick is inserted is welded to said glass tube when sealing the open end of said glass tube.

4. The method for manufacturing a fluorescent lamp according to claim 1, wherein said molding stick is made of a metal.

5. The method for manufacturing a fluorescent lamp according to claim 4, wherein said molding stick is made of at least one metal selected from the group consisting of tungsten, stainless steel and brass.

6. The method for manufacturing a fluorescent lamp according to claim 1, wherein the inner diameter of the part of said slender glass tube into which said large-diameter part of said molding stick is inserted is in the range from 3 to 3.5 mm.

7. The method for manufacturing a fluorescent lamp according to claim 1, wherein the inner diameter of the part of said slender glass tube into which said small-diameter part of said molding stick is inserted and which is welded to said glass tube is in the range from 0.5 to 2 mm.

8. The method for manufacturing a fluorescent lamp according to claim 1, wherein the length of the part of said slender glass tube into which said small-diameter part of said molding stick is inserted and which is welded to said glass tube is in the range from 0.5 to 15 mm.

9. The method for manufacturing a fluorescent lamp according to claim 1, wherein the length of a portion of said slender glass tube protruding outward from the sealed end of said glass tube is in the range from 2 to 15 mm.

* * * * *